US009465363B2

(12) United States Patent
Winkler et al.

(10) Patent No.: US 9,465,363 B2
(45) Date of Patent: Oct. 11, 2016

(54) TIMEPIECE OSCILLATOR MECHANISM

(71) Applicant: ETA SA Manufacture Horlogere Suisse, Grenchen (CH)

(72) Inventors: Pascal Winkler, St-Blaise (CH); Jean-Luc Helfer, Le Landeron (CH); Gianni Di Domenico, Neuchatel (CH); Thierry Conus, Lengnau (CH); Jean-Jacques Born, Morges (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/013,539

(22) Filed: Feb. 2, 2016

(65) Prior Publication Data

US 2016/0223989 A1 Aug. 4, 2016

(30) Foreign Application Priority Data

Feb. 3, 2015 (EP) ..... 15153657

(51) Int. Cl.
*G04B 17/04* (2006.01)
*G04B 17/08* (2006.01)

(52) U.S. Cl.
CPC ..... *G04B 17/04* (2013.01); *G04B 17/045* (2013.01); *G04B 17/08* (2013.01)

(58) Field of Classification Search
CPC .... G04B 17/00; G04B 17/04; G04B 17/045; G04B 17/06; G04B 17/08
See application file for complete search history.

(56) References Cited

U.S. PATENT DOCUMENTS

| | | | | |
|---|---|---|---|---|
| 3,186,157 A * | 6/1965 | Favret | G04B 17/066 310/37 |
| 3,447,311 A | 6/1969 | Beyner et al. | |
| 3,548,585 A | 12/1970 | Chopard et al. | |
| 3,600,973 A * | 8/1971 | Haag | G04B 17/04 368/160 |
| 7,950,846 B2 * | 5/2011 | Hessler | G04B 17/20 368/127 |
| 2011/0096636 A1 * | 4/2011 | Pellet | G04B 17/06 368/127 |

FOREIGN PATENT DOCUMENTS

| | | |
|---|---|---|
| CH | 451 021 A | 5/1968 |
| CH | 466 993 A | 2/1969 |
| FR | 563 314 A | 12/1923 |
| FR | 630 831 A | 12/1927 |
| GB | 1 293 159 A | 10/1972 |
| WO | WO 2015/104692 A2 | 7/2015 |

OTHER PUBLICATIONS

European Search Report issued Oct. 30, 2015 in European application 15153657, filed on Feb. 3, 2015 (with English Translation).

* cited by examiner

*Primary Examiner* — Vit W Miska
(74) *Attorney, Agent, or Firm* — Oblon, McClelland, Maier & Neustadt, L.L.P.

(57) ABSTRACT

A timepiece oscillator comprising a structure and distinct, temporally and geometrically offset, primary resonators, each comprising a mass returned to the structure by an elastic return means, this timepiece oscillator comprises coupling means for the interaction of the primary resonators, comprising a wheel set subjected to a torque or drive force, this wheel set comprising drive and guide means arranged to drive and guide a control means articulated with transmission means, each articulated, remote from the control means, with a mass of a primary resonator, and the primary resonators and the wheel set are arranged such that the axes of articulation of any two of the primary resonators and the axis of articulation of the control means are never coplanar.

23 Claims, 5 Drawing Sheets

TIMEPIECE OSCILLATOR MECHANISM

This application claims priority from European Patent Application No. 15153657.0 filed Feb. 3, 2015, the entire disclosure of which is hereby incorporated herein by reference.

FIELD OF THE INVENTION

The invention concerns a timepiece oscillator mechanism comprising a structure and/or a frame, and a plurality of distinct primary resonators, which are temporally and geometrically offset, and each comprising at least one inertial mass returned to said structure or to said frame by an elastic return means, The invention also concerns a timepiece movement including at least one such timepiece oscillator.

The invention concerns a watch including at least one such movement.

The invention concerns the field of timepiece oscillators, particularly for mechanical movements.

BACKGROUND OF THE INVENTION

Most current mechanical watches include a Swiss lever escapement. The two main functions of the escapement are:

maintaining the back and forth motions of the resonator, formed by a sprung balance assembly;

counting these back and forth motions.

In addition to these two functions, the escapement must remain robust, and resist shocks, and is devised to avoid jamming the movement (overbanking).

The Swiss lever escapement has low energy efficiency, on the order of 30%. This low efficiency is due to the fact that the escapement motions are jerky, and that several components transmit their motion via inclined planes which rub against each other.

FR Patent 630831 in the name of SCHIEFERSTEIN discloses a method and an arrangement for the transmission of power between mechanical systems and for the control of mechanical systems.

WO Patent 2015104693 in the name of EPFL discloses a mechanical isotropic harmonic oscillator which includes at least one connection with two degrees of freedom supporting an orbiting mass with respect to a fixed base with springs having isotropic and linear restoration force properties, wherein the mass has a tilting motion. The oscillator may be used in a time measuring device, for example a watch.

SUMMARY OF THE INVENTION

It is an object of the present invention to propose a highly efficient escapement system. There is also proposed an oscillator with no pivots and no reactions with respect to the support making it possible to attain a very high quality factor.

To achieve this object, the invention consists in the development of an architecture allowing continuous interactions, with no jerks, between the resonator and escape wheel. In order to achieve this, it is necessary to allow for the utilisation of at least a second resonator phase-shifted in relation to a first resonator.

To this end, the invention concerns a timepiece oscillator according to claim 1.

The invention also concerns a timepiece movement including at least one such timepiece oscillator.

The invention concerns a watch including at least one such movement.

BRIEF DESCRIPTION OF THE DRAWINGS

Other features and advantages of the invention will appear upon reading the following detailed description, with reference to the annexed drawings, in which:

FIG. 5 shows transmission means formed by flexible strips, replacing the connecting rods of the preceding Figures.

FIG. 6 illustrates a case with the coupling of two primary resonators, FIG. 7 of three such resonators.

DETAILED DESCRIPTION OF PREFERRED EMBODIMENTS

Figure 1:
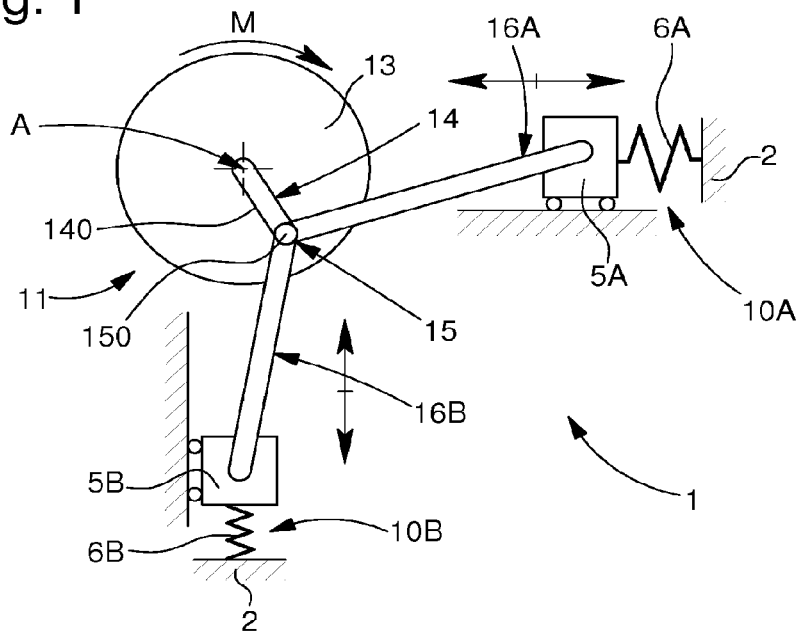
FIG. 1 shows a schematic plan view of a timepiece oscillator according to the invention, in a general case with two elementary mass-spring type resonators oscillating linearly and in different directions, and whose masses are articulated to connecting rods, which cooperate together in an articulated manner with a finger which traverses a groove of a wheel set subjected to a drive torque, in order to couple the two elementary resonators.

The invention concerns a mechanical watch 200 provided with balanced, phase-shifted and continuously maintained resonators.

The invention concerns a timepiece oscillator 1 comprising a structure 2 and/or a frame 4, and a plurality of distinct primary resonators 10.

These primary resonators 10 are temporally and geometrically offset. They each include at least one inertial mass 5, which is returned towards structure 2, or frame 4, by an elastic return means 6. "Distinct resonators" means that each primary resonator 10 has its own inertial mass 5 and its own elastic return means 6, notably a spring.

According to the invention, this timepiece oscillator 1 comprises coupling means 11, which are arranged to allow the interaction of primary resonators 10. Wheel set 13 is subjected to a force and/or to a drive torque. These coupling means 11 include drive means 12 arranged to drive one such wheel set 13. More specifically, drive means 12 are arranged to drive wheel set 13 in motion. Wheel set 13 includes drive and guide means 14, which are arranged to drive and guide, preferably in a captive manner, a mechanical control means 15. This control means 15 is articulated with a plurality of transmission means 16, each articulated, remote from control means 15, with an inertial mass 5 of a primary resonator 10.

Preferably, primary resonators 10 oscillate about axes that are parallel to each other.

The invention endeavours to offset the forces at the settings, both in translation and in rotation, unlike the known prior art, which only achieves translation offset.

Rotation offset is an important characteristic of the invention; it allows the oscillator to vibrate for longer and to enjoy a better quality factor. Moreover, sensitivity to shocks is reduced.

Of course, removing reaction efforts at the settings is not indispensable for operation of the oscillator, but it represents a very advantageous characteristic since this arrangement very considerably improves sensitivity to small shocks. Further, primary resonators 10 and wheel set 13 are arranged such that the articulation axes of any two of primary resonators 10 and the articulation axis of control means 15 are never coplanar. In other words, the projections of these axes in a common perpendicular plane are never aligned. It is understood that the articulation axes may, in some embodiments, be virtual pivot axes.

In the non-limiting variants illustrated in FIGS. 1 to 9, wheel set 13 is subjected to a rotational motion; more specifically, drive means 12 are arranged to drive wheel set 13 in a rotational motion about an axis of rotation A. In a particular variant embodiment, the drive and guide means 14 are formed by a groove 140 in which slides a finger 150 of control means 15. Preferably, this groove 140 is substantially radial with respect to the axis of rotation A of wheel set 13.

It is understood that wheel set 13 replaces a conventional escape wheel, and is preferably downstream of a going train powered by a barrel or similar element.

Transmission means 16 may, in particular, take the form of connecting rods 160, each comprising a first articulation 161 with control means 15, and a second articulation 162 with the inertial mass 5 concerned. First articulation 161 and second articulation 162 together define a connecting rod direction. According to the invention, at any time, all the connecting rod directions, in pairs, form an angle different from zero or $\pi$. Formulated in another way, the vector product of the two connecting rod directions is different from zero.

In a particular application, transmission means 16 are non-collinear connecting rods 160. Wheel set 13, subjected to a drive torque, and coupling means 11 have a geometry of interaction that allows essentially tangential forces to be transmitted to connecting rods 160.

"Elementary resonators" hereafter refers to resonators forming together a primary resonator: they are mounted as a tuning fork, so that reaction efforts and errors cancel each other out. When a number n of elementary resonators together form a primary resonator, they are mutually phase-shifted by $2\pi/n$.

Figure 4:
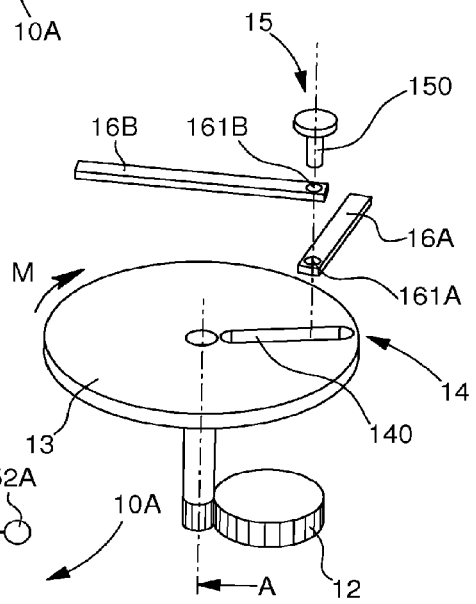
FIG. 4 shows a schematic, perspective view of a detail of the articulation of the connecting rods of FIGS. 1 to 3.

FIG. 1 illustrates the general case of two elementary resonators 10A and 10B of the mass—spring type oscillating linearly and in different directions, and having masses 5A and 5B which are articulated to connecting rods 16A and 16B, which cooperate together in an articulated manner with a finger 150, which forms control means 15, which traverses a groove 140 of a wheel forming wheel set 13. The drive means are shown in FIG. 4 which shows a detail at the articulation of the connecting rods on control means 15.

In a particular, preferred, but non-limiting application, illustrated by the Figures, primary resonators 10 are rotating resonators. This means that at least one wheel set of the primary resonator has a large amplitude of oscillation, preferably greater than 180° and advantageously greater than 270°. This rotating resonator is distinguished from an angular resonator with strips set in a cantilever arrangement known from the prior art Patent FR630831, wherein the oscillation of a strip is limited to a small angle, on the order of 30°.

These rotating primary resonators 10 are not sensitive to shocks in translation, and to problems of positioning, unlike linear and angular resonators.

Figure 2:
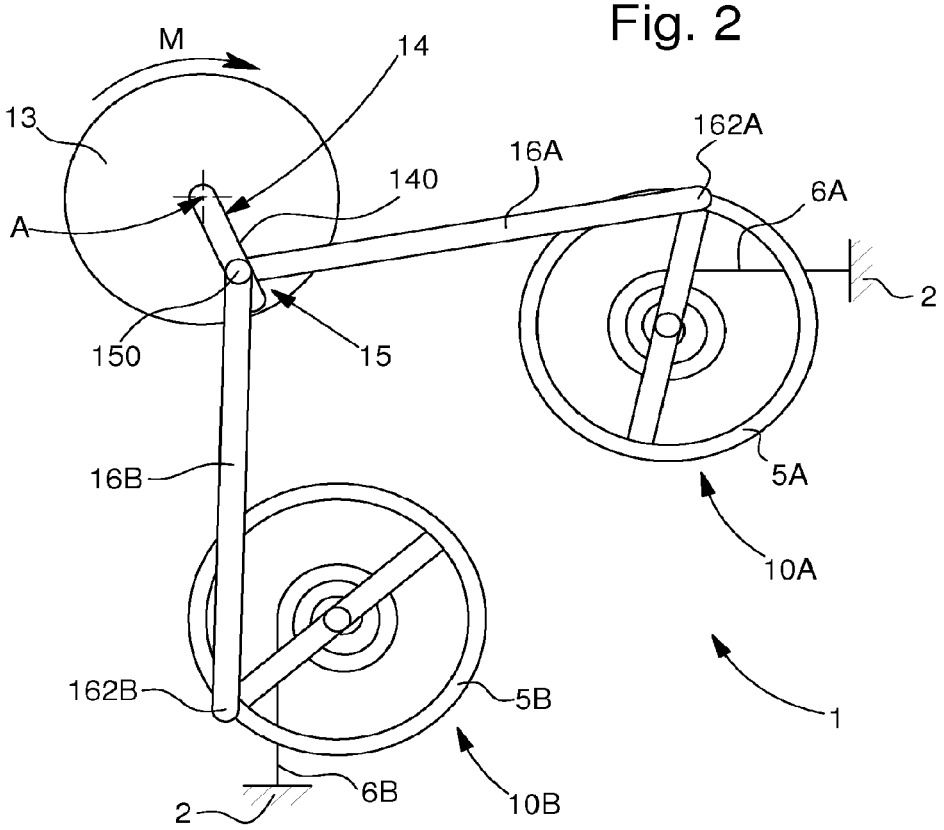
FIG. 2 shows a schematic plan view of another variant where the primary resonators are rotating resonators of the sprung-balance type.

FIG. 2 illustrates one such example, where primary resonators 10A, 10B are sprung balance assemblies, where balance springs 6A, 6B are attached by their outer coil to structure 2, and by their inner coil to balances 5A, 5B, which are articulated with the ends 162A, 162B, of connecting rods 16A, 16B, arranged in a similar manner to those of FIG. 1.

To obtain a better quality factor, oscillator 1 is arranged such that the reaction forces and torques of all the primary resonators 10 on support 2 (or on frame 4 if they are all fixed to such a frame) cancel each other out. The forces are cancelled out because the centre of mass does not move or barely moves, when the axis of rotation passes through the centre of mass. The centre of mass substantially coincides with the centre of rotation, i.e. with a positional deviation of only a few micrometers or tens of micrometers. The torques are cancelled out since each rotating component is offset by another inversely rotating component. The coupling between the resonator may occur by means of a flexible setting, such as in a tuning fork, or via connecting rods 160, or, more generally, transmission means 16. The coupling of primary resonators 10 to each other is then achieved by means of a flexible setting of each of primary resonators 10 with respect to common structure 2 or to frame 4.

Thus, preferably, the resultant of the reaction forces and torques of primary resonators 10 with respect to common structure 2 or to frame 4, to which they are fixed, is zero, owing to the out-of-phase arrangement of the n primary resonators 10, particularly rotating resonators.

For optimum operation, rotating primary resonators 10 are arranged such that their centres of mass remain in a fixed position, at least during the normal oscillations of primary resonators 10. Timepiece oscillator 1 preferably includes stop means for limiting their travel the event of shocks or suchlike.

Preferably, primary resonators 10 have at least one substantially identical resonance mode; they are arranged to vibrate with a mutual phase shift of value $2\pi/n$, where n is the number of primary resonators, and they are arranged symmetrically in space such that the resultant of the forces and torques applied by primary resonators 10 to structure 2, or to a frame 4 which carries them, is zero.

"A substantially identical resonance mode" means that these primary resonators 10 have substantially the same amplitude, substantially the same inertia, and substantially the same natural frequency. The temporal phase shift of $2\pi/n$ is the most important. In a particular application, as seen in the Figures, there is an even number of primary resonators 10, and two by two, they form pairs in which inertial masses 5 are in motion, phase-shifted by $\pi$ in relation to each other.

Figure 3:
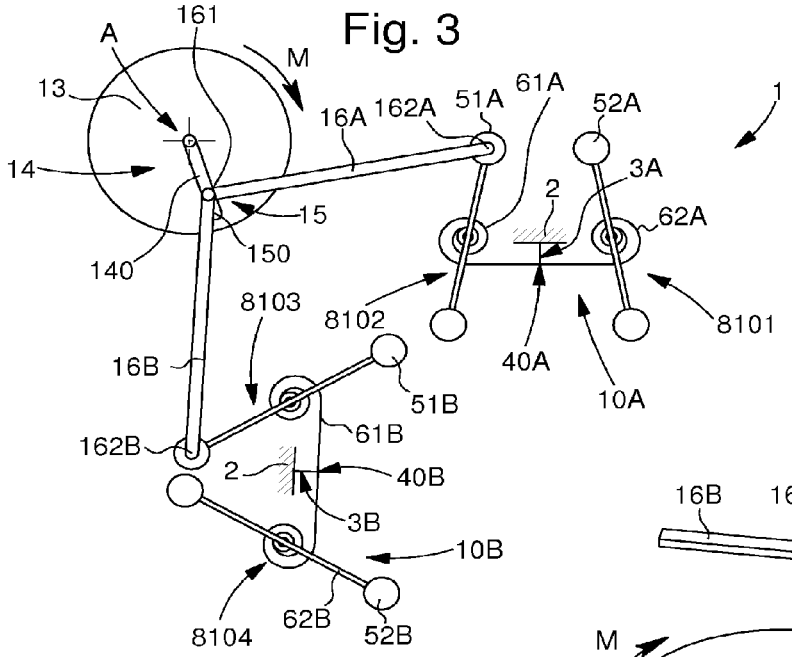
FIG. 3 shows a schematic plan view of another variant with two primary resonators each formed by a pair of elementary resonators, which each include an elementary mass carried by an elementary flexible elastic strip in the form of a balance spring, forming an elastic return means, and which is arranged to work in flexion, and which is set in a crosspiece; each primary resonator thus forms, through the combination of these two elementary resonators, a goat horn-shaped isochronous tuning fork oscillator mechanism.
Figure 5:
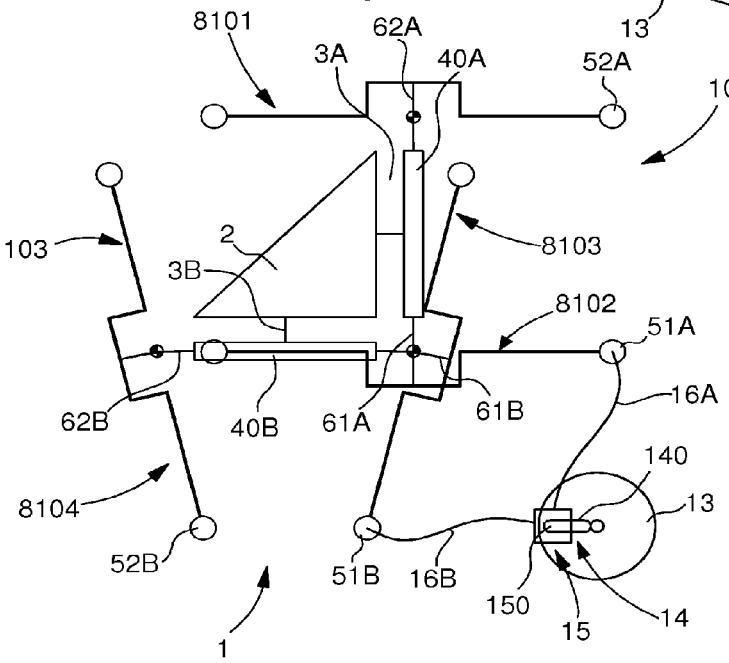
FIG. 5 similarly shows a similar structure to that of FIG. 3, where the flexible elastic strips are no longer formed by balance springs, but by short straight strips, disposed on either side of a crosspiece with which they form the horizontal bar of an H where the masses form the vertical bars; each primary resonator thus forms, through the combination of these two elementary resonators, an isochronous H-shaped tuning fork oscillator mechanism; this

In a particular arrangement, as seen in FIGS. 3 and 5, at least one of primary resonators 10 is formed by a plurality of n elementary resonators 810. These elementary resonators 810 each include at least one elementary mass carried by an elementary flexible elastic strip, forming an elastic return means, and which is arranged to work in flexion, and which is set in an elementary crosspiece.

These elementary resonators 810 have at least one substantially identical resonance mode, and are arranged to vibrate with a mutual phase shift of value $2\pi/n$, where n is the number of elementary resonators 810. They are arranged symmetrically in space, such that the resultant of the forces and torques applied by elementary resonators 810 to the elementary crosspiece is zero.

This elementary crosspiece is fixed to fixed support 2 by a main elementary elastic connection, whose stiffness is greater than the stiffness of each elementary flexible elastic strip, and whose damping is greater than the damping of each elementary flexible strip. Elementary resonators 810 are arranged in space such that the resultant of their running error due to gravity is zero.

More specifically, at least one of primary resonators 10 is formed of a pair of such elementary resonators 810. In this pair, the elementary inertial masses are in motion, mutually phase-shifted by $\pi$.

More specifically still, this pair is formed of identical elementary resonators 810, which are in geometric and phase opposition with respect to each other.

In the specific case of FIGS. 3 and 5, each primary resonator 10 is formed of one such pair of elementary resonators 810.

In the variant of FIG. 3, each primary resonator 10A, 10B thus forms, through the combination of two elementary resonators 8101, 8102, respectively 8103, 8104, an isochronous goat horn-shaped tuning fork oscillator mechanism. A crosspiece 40A, respectively 40B is secured to fixed support 2 by a main elastic connection 3A, respectively 3B, whose stiffness is greater than the stiffness of each flexible elastic strip 61A, 62A, respectively 61B, 62B. The damping of this main elastic connection is greater than that of each flexible strip. These characteristics ensure coupling between elementary resonators 8101 and 8102, respectively 8103 and 8104.

In this variant, each primary resonator 10 is balanced individually in translation and in rotation.

For each primary resonator 10A, 10B, at least the main elastic connection 3A, respectively 3B, crosspiece 40A, respectively 40B, flexible elastic strips 61A, 62A, respectively 61B, 62B, together form a plane primary one-piece structure, made of micromachinable material, such as silicon or silicon oxide, or quartz, or DLC, or similar, which, in the rest position of isochronous oscillator mechanism 1 is symmetrical with respect to a plane of symmetry. Advantageously, fixed support 2 forms a one-piece assembly with these two primary one-piece structures. A "plane structure" means that this one-piece structure is a straight prism, created by raising a two-dimensional contour, along a direction of elongation, and delimited by two end planes that are parallel to each other and perpendicular to this direction of elongation of the prism.

If, in a specific embodiment, the one-piece structure has a constant thickness defined by the distance between these two end planes, and consequently has only one level; in certain variants certain areas, particularly flexible strips of the one-piece structure, may occupy only part of the thickness.

One such particularly advantageous one-piece embodiment, is applicable to different non-limiting variants of the invention illustrated in the present description.

In a first variant, the one-piece structure is developed by a growth method, of the MEMS or LIGA type or similar.

In another variant, the one-piece structure is developed by cutting a plate, for example by wire and/or cavity sinking electro-erosion.

Crosspiece 40A, respectively 40B, carries a pair of masses 5, referenced 51A and 52A, respectively 51B and 52B, mounted symmetrically on either side of fixed support 2 and of main elastic connection 3A, respectively 3B. Each of these masses is mounted in an oscillating manner and returned by a flexible elastic strip 61A, 62A, respectively 61B, 62B, which is a balance spring, or even an assembly of balance springs. The inner coils of these balance springs are each directly or indirectly connected to a mass and the outer coils are attached to crosspiece 40A, respectively 40B. Each mass pivots about a virtual pivot axis having a determined position relative to crosspiece 40A, respectively 40B. In the rest position of isochronous oscillator mechanism 1, each virtual pivot axis coincides with the centre of mass of the respective mass. The masses extend substantially parallel to each other in the rest position, in a transverse direction. To limit the displacement of the centres of mass to a transverse travel relative to crosspiece 4, which is as small as possible in transverse direction Y, and to a longitudinal travel in a longitudinal direction (perpendicular to the transverse direction) which is greater than said transverse travel, each balance spring has a variable section or curvature along its developed length.

The variant of FIG. 5 is a similar structure to that of FIG. 3, where each primary resonator 10A, 10B, forms, through the combination of two elementary resonators 8101, 8102, respectively 8103, 8104, an isochronous H-shaped tuning fork oscillator mechanism. Flexible elastic strips 6: 61A, 62A, respectively 61B, 62B, are no longer formed by balance springs, but by short straight strips. A "short strip"

is a strip whose length is less than the smallest value between four times its height or thirty times its thickness, this short strip characteristic making it possible to limit the displacements of the centre of mass concerned. These short strips are disposed here on either side of a crosspiece 40A, respectively 40B, with which they form the horizontal bar of an H where the masses form the vertical bars. As a result of symmetry and alignment, the longitudinal arrangement of the flexible elastic strips can offset the direction of greatest displacement of the centres of mass, which move symmetrically with respect to the plane of symmetry.

Each primary resonator 10A, 10B, thereby rendered isochronous by one of these particular combinations of elementary resonators, advantageously includes rotation stop members, and/or translation limit stops in the longitudinal and transverse directions, and/or translation limit stops in a perpendicular direction to the two preceding directions. These travel limiting means may be incorporated, form part of a one-piece design, and/or be added. The masses advantageously include stop means arranged to cooperate with complementary stop means comprised in cross pieces 40A, 40B, to limit the displacement of the flexible elastic strips with respect to the crosspieces, in the event of shocks or similar accelerations.

FIG. 5 also illustrates an advantageous variant wherein transmission means 16A, 16B are flexible elastic strips. It is then possible to create a one-piece assembly comprising structure 2, primary resonators 10 as described above, particularly whole resonators, and these flexible elastic strips, and finger 150.

Figure 6:
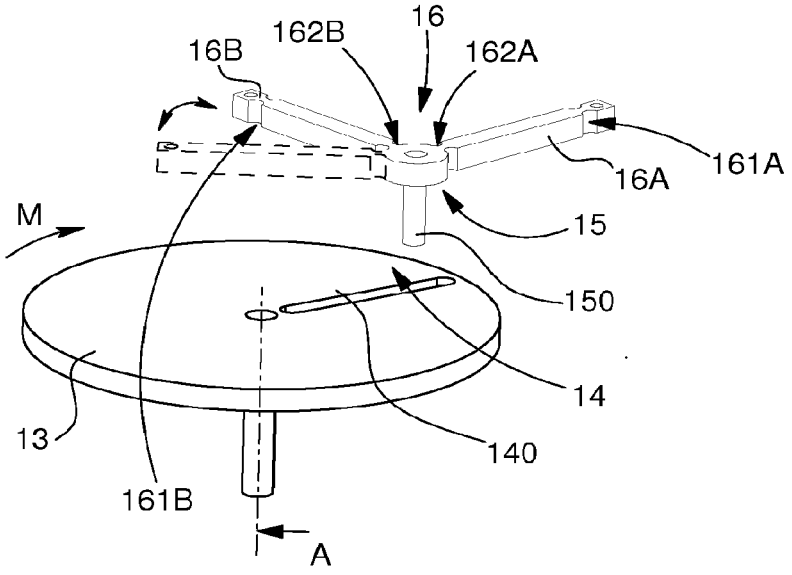
FIGS. 6 and 7 show schematic perspective views of variants where the connecting rods are bars comprising necks at both ends instead of hubs.
Figure 7:
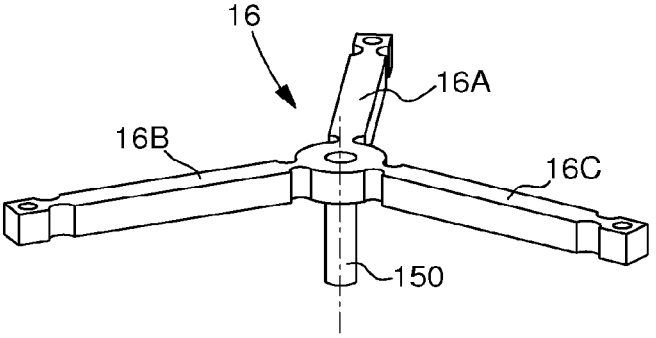

FIGS. 6 and 7 illustrate variants wherein the connecting rods are bars comprising necks at both ends instead of hubs. FIG. 6 illustrates a case of the coupling of two primary resonators, and FIG. 7 of three such resonators. Transmission means 16 thus include at least one one-piece connecting rod arranged to cooperate both with control means 15 and with at least two inertial masses 5 of as many primary resonators 10, and include at least one flexible neck in each articulation area.

FIGS. 1, 2, 3 and 5 illustrate a timepiece oscillator 1 comprising two primary resonators 10.

In a particular embodiment, timepiece oscillator 1 includes at least three primary resonators 10.

Figure 8:
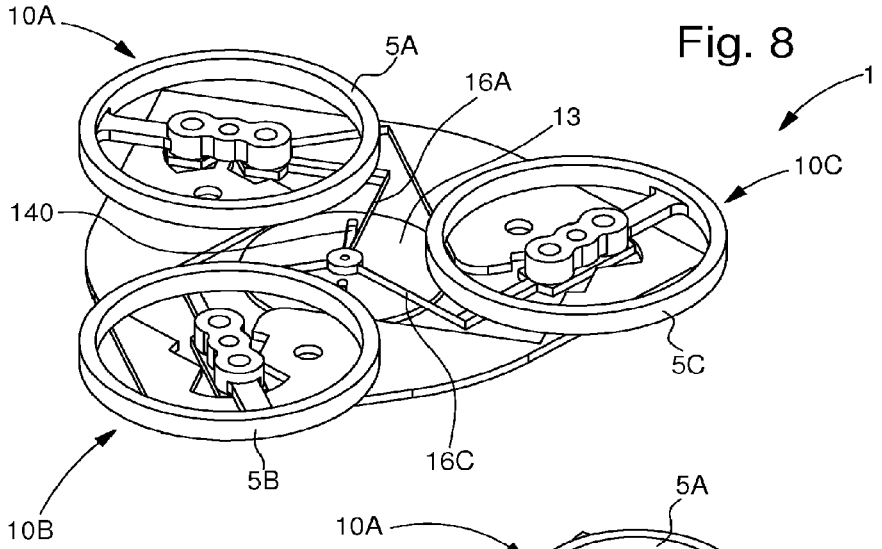
FIG. 8 shows a schematic perspective view of a timepiece oscillator comprising three primary resonators 1 disposed in a triangle around their common control means; this Figure shows the application of the coupling of FIG. 7 to the inertial masses of the three primary resonators.

FIG. 8 illustrates a timepiece oscillator 1 comprising three primary resonators 10. This Figure shows the application of the coupling of FIG. 7 to inertial masses 5A, 5B, 5C, of the three primary resonators 10A, 10B, 10C.

Figure 9:
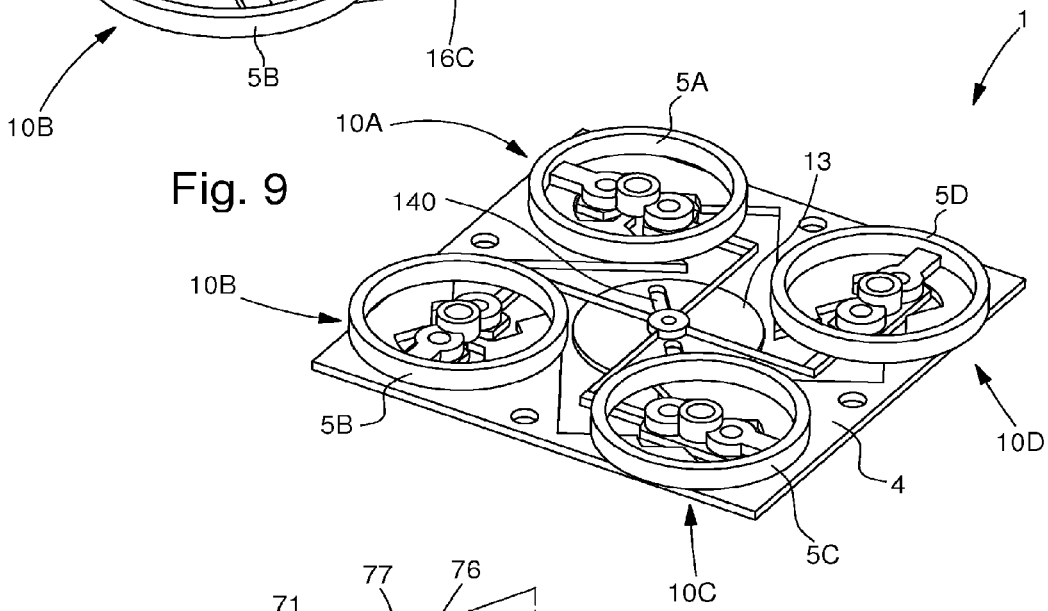
FIG. 9 shows, in a similar manner to FIG. 8, a timepiece oscillator comprising four resonators.

FIG. 9 illustrates a timepiece oscillator 1 comprising four resonators. These four resonators may be four primary resonators 10. They may also be four elementary resonators, forming, two by two, primary resonators: one formed of elementary resonators 10A and 10C, phase-shifted by $\pi$, the other formed of elementary resonators 10B and 10D, also phase-shifted by $\pi$.

For the embodiments of these FIGS. 8 and 9, each resonator taken in isolation has a reaction at the setting, and it is the juxtaposition and careful combination of the "n" resonators that offsets all the reactions.

In short, the invention covers all the combinations between primary resonators which are:

- either each separately balanced, or balanced as a unit by means of their particular arrangement,
- balanced in translation and/or in rotation.

Figure 10:
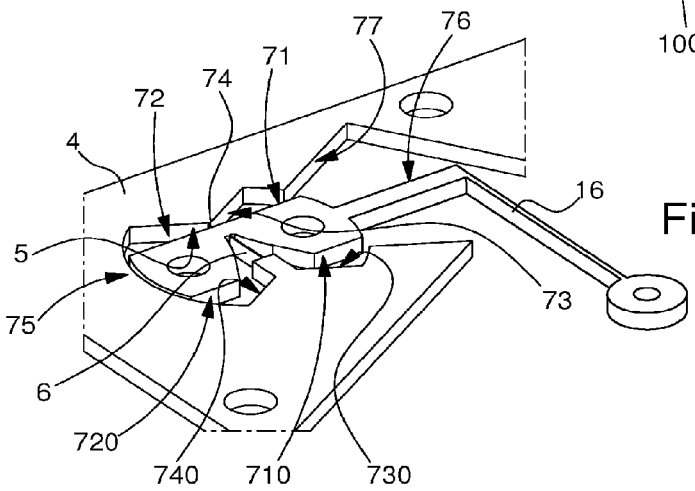
FIG. 10 shows a schematic perspective view of a variant wherein an elastic return means also forms a rotating guide member, a transmission means is formed by a flexible strip, in the configuration of FIG. 9; this Figure also shows angular stop members and shock resistant stop members, arranged on a one-piece assembly combining a frame, short flexible strips, the inertial masses, the transmission means and the interface with the control means.
Figure 12:
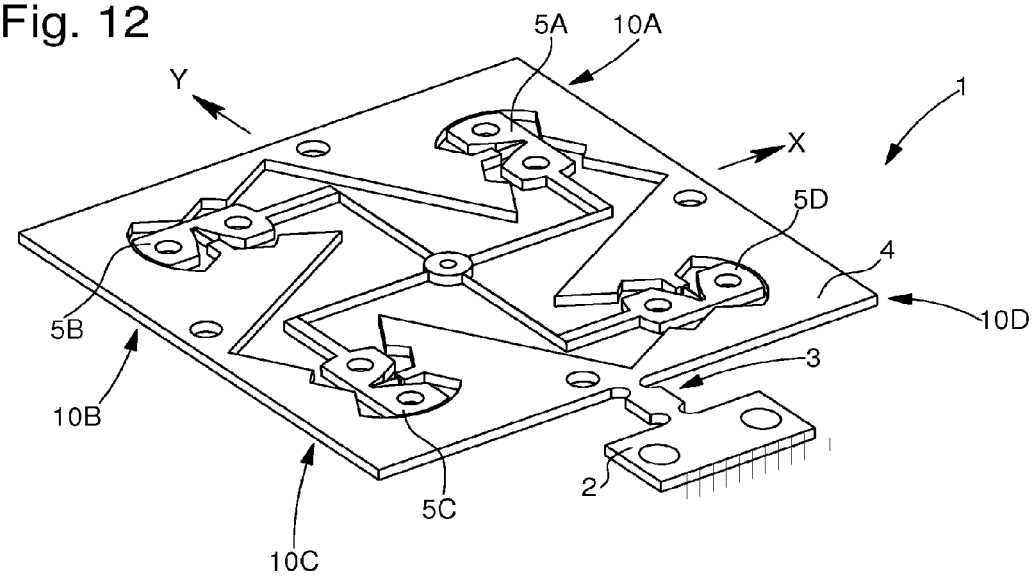
FIG. 12 shows a schematic perspective view of the extrapolation of the one-piece assembly of FIG. 10 to a mechanism comprising four inertial masses; this assembly is enlarged, and also comprises the carrier structure, and a main elastic connection for suspension of the frame from the structure.?
Figure 13:
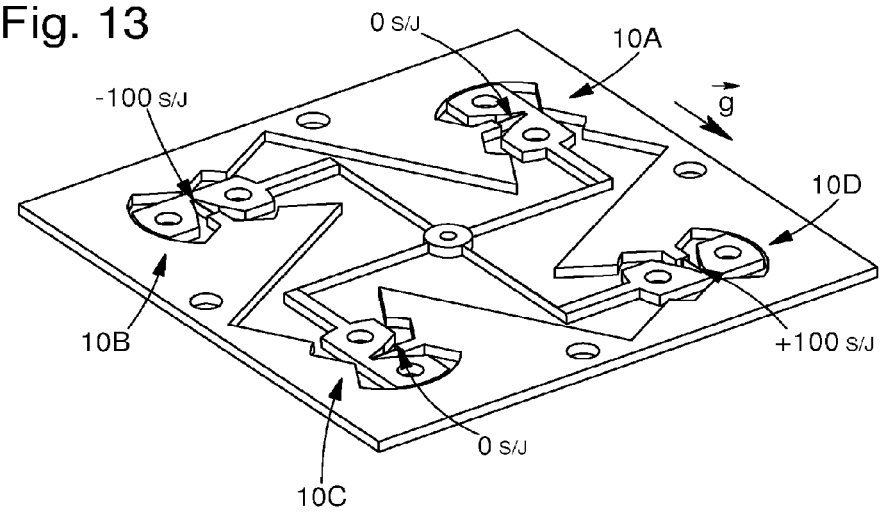
FIG. 13 shows the assembly of FIG. 10 in a gravitational field.
Figure 14:
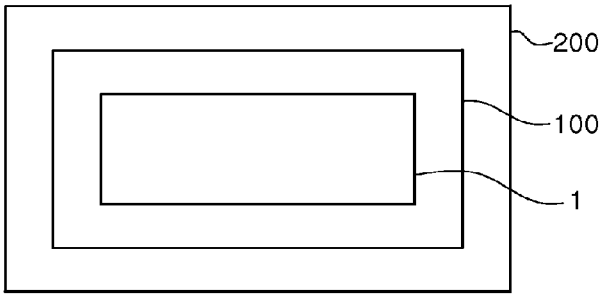
FIG. 14 is a block diagram showing a watch including a movement which incorporates a timepiece oscillator according to the invention.

FIGS. 10, 12 and 13 illustrate a variant wherein at least one elastic return means 6 also forms a rotating guide member, which prevents the inherent friction caused by the use of pivots.

FIG. 10 shows a transmission means 16 formed by a flexible strip, in the FIG. 9 configuration. This Figure also shows angular stop members: 71, 72, 710, 720, 76 on mass 5, the respective complementary stop surfaces 73, 74, 730, 740, 77 on frame 4 on which is attached a short flexible strip 6, and a shock absorber stop surface 75 on mass 5, arranged to cooperate with a complementary surface 750 on frame 4. These integrated shock absorbers are particularly advantageous and require no adjustment.

In the illustrated variants, wheel set 13 is subjected to a rotational motion; more specifically, drive means 12 are arranged to drive wheel set 13 in a rotational motion, and wheel set 13 and drive and guide means 14 are arranged to apply to control means 15 an essentially tangential force relative to the rotation of wheel set 13.

Figure 11:
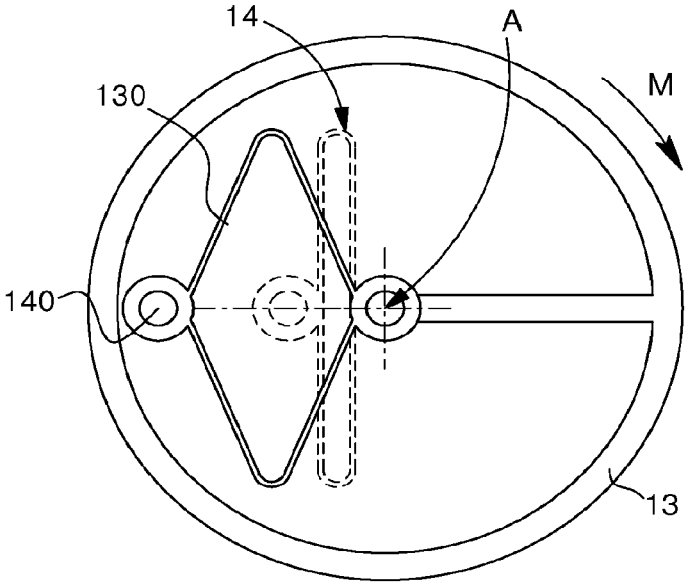
FIG. 11 shows a schematic plan view of a variant wherein the wheel set includes a deformable elastic structure, forming a radially flexible and tangentially stiff guide member, comprising a housing for receiving a finger of the control means, at the main articulation, the deformable structure being shown in two extreme positions.

FIG. 11 illustrates a variant wherein wheel set 13 comprises a deformable elastic structure 130, forming a radially flexible and tangentially stiff guide member, this deformable structure 130 comprises a housing 140 for cooperating with finger 150 of control means 15, at the main articulation.

In the different variants described here, elastic return means 6 of primary resonators 10 preferably include flexible strips, and primary resonators 10 and/or common structure 2, and/or frame 4, comprise radial and/or angular and/or axial stop members arranged to limit the deformations of the flexible strips and to prevent breakage in the event of shocks or excessive drive torque.

In one advantageous embodiment, as seen in particular in FIGS. 12 and 13, timepiece oscillator 1 comprises a one-piece structure which combines a common structure 4 to which inertial masses 5 are returned by elastic return means 6, control means 15 and its articulations with transmission means 16 and transmission means 16 with their articulations to inertial masses 5. The desired phase shifts are perfectly guaranteed, as is the cancelling out of reactions.

Such one-piece structures make it possible to dispense with conventional pivots, by implementing flexible strips which have a dual function: the pivot guide member forming a virtual pivot, and the elastic return.

Advantageously, this one-piece structure also includes stop members.

Preferably, the orientation of elastic return means 6 of primary resonators 10 is optimised so that running errors due to gravity are cancelled out between primary resonators 10.

In a non-illustrated variant, elastic return means 6 of primary resonators 10 are virtual pivots with intersecting strips.

In a particular variant of timepiece oscillator 1 according to the invention, primary resonators 10 are isochronous.

Preferably, at least the elastic means comprised in timepiece oscillator 1 according to the invention are temperature compensated. An embodiment in micromachinable material can ensure such compensation.

The invention also concerns a timepiece movement 100 including at least one such timepiece oscillator 1.

The invention also concerns a watch 200 including at least one movement 100 of this type.

The invention has numerous advantages:

- a wheel with a groove, unlike an elastic connection on a crank piece, does not add any unwanted return force to the resonator when the amplitude changes. this results in better isochronism;
- the utilisation of rotating resonators whose centre of rotation substantially coincides with the centre of mass prevents the centre of mass moving in the field of gravity, and thereby prevents the period being affected by a change of orientation of the watch. The same argument explains why this system is less affected by shocks in translation;

preferably, the resonators are all identical and mounted in parallel. The motions of one thus do not risk interfering with the inertia of the other, unlike arrangements in series;

the utilisation of two or more completely distinct resonators, i.e. with an inertial mass peculiar to each primary or elementary resonator, makes it possible to optimise the isochronism of the resonators separately, and to act on their orientation so that errors due to position and reactions at the setting are cancelled out. This is a great advantage for obtaining an oscillator that is independent of the positions of the watch and has a very high quality factor.

the design allows for very simple manufacture of the integrated version;

the invention permits production in the purest watchmaking tradition, since it is possible simply to use two sprung balance assemblies connected to the escape wheel by very light connecting rods or flexible strips.

What is claimed is:

1. A timepiece oscillator comprising a structure and/or a frame, and a plurality of distinct, temporally and geometrically offset, primary resonators, each comprising at least one inertial mass returned to said structure or to said frame by an elastic return means, wherein said timepiece oscillator includes coupling means arranged to allow the interaction of said primary resonators, said coupling means including a wheel set subjected to a torque or a drive force, said wheel set includes drive and guide means arranged to drive and guide a control means, which is articulated with a plurality of transmission means, each articulated, remote from said control means, with a said inertial mass of a said primary resonator, and further wherein said primary resonators and said wheel set are arranged such that the axes of articulation of any two of said primary resonators and the axis of articulation of said control means are never coplanar, wherein said primary resonators are rotating resonators, and wherein the centres of mass of said primary resonators remain, during the normal oscillations of said primary resonators, in immediate proximity to the centres of rotation of said primary resonators.

2. The timepiece oscillator according to claim 1, wherein the resultant of the reaction forces and torques of all of said primary resonators with respect to said structure or to said frame is zero.

3. The timepiece oscillator according to claim 1, wherein said primary resonators have at least one substantially identical resonance mode, and are arranged to vibrate with a mutual phase-shift of value $2\pi/n$, where n is the number of said primary resonators.

4. The timepiece oscillator according to claim 1, wherein the centres of mass of said primary resonators remain in a fixed position during the normal oscillations of said primary resonators.

5. The timepiece oscillator according to claim 1, wherein said transmission means are flexible elastic strips.

6. The timepiece oscillator according to claim 1, wherein said transmission means thus include at least one one-piece connecting rod arranged to cooperate both with said control means and with at least two said inertial masses of as many said primary resonators, and include at least one flexible neck in each articulation area.

7. The timepiece oscillator according to claim 1, wherein said transmission means include connecting rods each including a first articulation with said control means and a second articulation with said inertial mass, said first articulation and said second articulation together defining a connecting rod direction, and wherein all of said connecting rod directions form, in pairs, at any time, an angle different from zero or $\pi$.

8. The timepiece oscillator according to claim 1, wherein said wheel set is subjected to a rotational motion, and wherein said wheel set and said drive and guide means are arranged to apply to said control means an essentially tangential force with respect to said rotation of said wheel set.

9. The timepiece oscillator according to claim 1, wherein said wheel set is subjected to a rotational motion, and wherein said wheel set comprises an elastic structure forming a radially flexible and tangentially stiff guide member.

10. The timepiece oscillator according to claim 1, wherein said elastic return means of said primary resonators preferably include flexible strips, and wherein said primary resonators and/or said structure, and/or said frame, comprise radial and/or angular and/or axial stop members arranged to limit the deformations of said flexible strips and to prevent breakage in the event of shocks or excessive drive torque.

11. The timepiece oscillator according to claim 1, wherein said timepiece oscillator comprises a one-piece structure which combines a common structure to which are returned said inertial masses and the elastic return means thereof, said control means and the articulations thereof with said transmission means, and said transmission means with the articulations thereof to said inertial masses.

12. The timepiece oscillator according to claim 10, wherein said timepiece oscillator comprises a one-piece structure which combines a common structure to which are returned said inertial masses and the elastic return means thereof, said control means and the articulations thereof with said transmission means, and said transmission means with the articulations thereof to said inertial masses, and wherein said one-piece structure further includes said stop members.

13. The timepiece oscillator according to claim 11, wherein said one-piece structure is a straight prism delimited by two planes that are parallel to each other and perpendicular to the direction of elongation of said prism.

14. The timepiece oscillator according to claim 1, wherein said elastic return means of said primary resonators comprise short rectilinear strips, whose length is less than the smallest value between four times the height or thirty times the thickness of said strips.

15. The timepiece oscillator according to claim 1, wherein said primary resonators are isochronous.

16. The timepiece oscillator according to claim 1, wherein a drive means is arranged to drive said wheel set in a rotational motion, and wherein said drive and guide means are formed by a groove in which slides a finger comprised in said control means.

17. The timepiece oscillator according to claim 16, wherein said groove is substantially radial with respect to the axis of rotation of said wheel set.

18. The timepiece oscillator according to claim 1, wherein said primary resonators together form an isochronous H-shaped tuning fork oscillator mechanism and each comprise flexible elastic strips formed by short straight strips, whose length is less than the smallest value between four times the height or thirty times the thickness of said strips, disposed on either side of a crosspiece with which the strips form the horizontal bar of an H wherein said masses form the vertical bars.

19. The timepiece oscillator according to claim 1, wherein said primary resonators together form an isochronous goat horn-shaped tuning fork oscillator mechanism and each comprise a crosspiece carrying said masses each mounted in an oscillating manner and returned by a flexible elastic strip which is a balance spring or an assembly of balance springs, each said balance spring being directly or indirectly connected to one said mass at the inner coil thereof, and attached to said crosspiece via the outer coil thereof, each said balance spring having a variable section or curvature along the developed length thereof.

20. The timepiece oscillator according to claim 1, wherein at least said elastic return means also forms a rotating guide member.

21. The timepiece oscillator according to claim 1, wherein at least said elastic return means comprised therein are temperature compensated.

22. A timepiece movement including at least one timepiece oscillator according to claim 1.

23. A watch including at least one movement according to claim 22.

* * * * *